United States Patent [19]

Schultz

[11] 3,963,018

[45] June 15, 1976

[54] COMBUSTION FURNACE AND INFRA-RED RADIANT HEATING SYSTEM

[75] Inventor: Russell H. Schultz, West Islip, N.Y.

[73] Assignee: Natural Resource Systems, Inc., West Islip, N.Y.

[22] Filed: June 12, 1975

[21] Appl. No.: 586,171

Related U.S. Application Data

[60] Continuation-in-part of Ser. No. 458,350, April 5, 1974, abandoned, which is a division of Ser. No. 350,265, April 11, 1973, abandoned.

[52] U.S. Cl. ..... 126/91 A; 431/158

[51] Int. Cl.[2] ..... F24C 3/06

[58] Field of Search ..... 431/158, 31; 126/91 A, 126/200 A; 60/39.69; 432/247

[56] References Cited

UNITED STATES PATENTS

| | | | |
|---|---|---|---|
| 2,638,895 | 5/1953 | Swindon | 126/360 |
| 2,696,874 | 12/1954 | Schell | 431/31 |
| 3,786,799 | 1/1974 | Cox | 126/91 A |

*Primary Examiner*—William E. Wayner
*Assistant Examiner*—William E. Tapolcai, Jr.
*Attorney, Agent, or Firm*—Kenyon & Kenyon Reilly Carr & Chapin

[57] ABSTRACT

A combustion chamber especially adapted for use in a high heating capacity, positive-pressure, single-pass radiant heating system employing an oil-fired burner as the heat source comprises a generally cylindrical body having conical ends, one of which has a high degree of taper and is adapted to mount the air tube of an oil-fired burner, and the other of which has a lower degree of taper and is adapted to mount a heating conduit through which combustion products are passed.

12 Claims, 3 Drawing Figures

COMBUSTION FURNACE AND INFRA-RED RADIANT HEATING SYSTEM

This application is a continuation in part of application Ser. No. 458,350, filed Apr. 5, 1974, now abandoned, which, in turn, is a division of application Ser. No. 350,265 filed Apr. 11, 1973, now abandoned.

BACKGROUND OF THE INVENTION

The present invention relates to a combustion chamber. In a preferred embodiment, this invention relates to a combustion chamber to be employed in a radiant heating system. In an especially preferred embodiment, this invention is concerned with a combustion chamber to be employed in a high heating capacity, positive-pressure, single-pass radiant heating system employing an oil-fired burner as the heat source.

Infra-red radiant heating systems have become of considerable importance, especially for heating large spaces such as factories, aircraft hangars and the like. Such systems have become of even more importance with the worsening fuel crisis and the increasing concern over atmospheric pollution because they are more efficient and "cleaner" than other heating systems. Thus the use of radiant heating systems in place of more conventional heating systems will reduce fuel consumption and atmospheric pollution.

As originally conceived, such systems employed a porous, ceramic mat as the heating element. Fuel gas was passed through the pores of the mat and burned at the outer surface, causing the mat to heat up and emit infra-red radiation. Because of the danger inherent in open-flame devices of this type, systems in which a fuel is burned in a combustion chamber and the products of combustion are conducted through an elongated conduit to cause the conduit to be heated and emit infra-red radiation were developed. Systems of this type are disclosed, for example, in U.S. Pat. Nos. 2,946,510 to Galvin, 3,399,833 to Johnson and 3,416,512 to Mintz. In these systems the conduit is not heated to the point of emitting visible light. Although the use of oil-fired burners has been suggested, in actual practice gas-fired burners have been employed as the heat source. Because the current fuel crisis is most critical with respect to gas, oil-fired systems are particularly desired today.

In one form of these systems, a closed loop circuit is employed in which the combustion products are recirculated through the heating conduit to eliminate the need to heat air from ambient temperatures up to combustion temperatures, and thus improve the heat efficiency of the system. However, systems of this type are complex and expensive to install, and since the heat capacity of air is small, there is little practical value to such systems.

Other systems employ a single-pass concept in which the combustion gases are not recycled, but are exhausted from the heating conduit to the atmosphere, either directly or through a stack. In general, such systems require some means to induce the flow of combustion gas through the heating conduit. In the single-pass system this means has comprised an exhaust fan mounted at the exit end of the heating conduit which draws the combustion gases through the conduit. As a result, the system is a vacuum system, a feature which is claimed to be advantageous because, in the event a leak develops, combustion gases will not be vented to the area being heated. Unfortunately, this advantage has proven to be illusory in practice, and such systems can be extremely dangerous in the event of a failure of the exhaust fan. In this case, air is not removed from the vicinity of the burner and the burner overheats, frequently to the point of causing the adjacent tubing to emit a visible glow, thus presenting an obvious fire hazard, as well as the possibility of damage to the heating system. Safety devices have been developed to avoid this danger, but they increase the cost and complexity of the system and are themselves prone to failure.

Finally, the currently available systems have relatively low heat capacities, generally not greater than 100,000 Btu/hour, although in some cases units having capacities of up to 140,000 Btu/hour are available. Accordingly, it has been found necessary to employ several independent heating systems in parallel, or systems in which a series of burners are spaced along a single conduit where greater heating capacity was desired.

It is an object of this invention to provide an improved radiant heating system.

It is a further object of this invention to provide a positive-pressure radiant heating system.

A further object of this invention is to provide an oil-fired radiant heating system.

A still further object of this invention is to provide a high heating capacity radiant heating system.

Another object of this invention is the provision of a positive-pressure, high heating capacity, single-pass, oil-fired radiant heating system.

Still another object of this invention is the provision of a combustion chamber especially adapted for use in an oil-fired radiant heating system as descirbed above.

SUMMARY OF THE INVENTION

Briefly, the present invention involves a combustion chamber of unique design which is especially adapted for use in an oil-fired, single-pass, high heating capacity, positive-pressure, radiant heating system. The chamber comprises a generally tubular, open-ended body having on the ends thereof frustum-shaped, outwardly disposed, coaxially mounted members, one of which is adapted to receive the air tube of a fluid-fuel burner and the other of which is adapted to mount the heating conduit of an infra-red heating system. The dimensions and configuration of the combustion chamber are such that the contours of the interior of the chamber and the burner flame are generally coincident, back pressure in the chamber is minimized, and pulsation is essentially eliminated.

In a high heating capacity system of the type contemplated herein it is important that the heat generated in the combustion chamber be distributed over as wide an area as possible to achieve efficient fuel utilization. Thus, the hot combustion gases must be passed through as extensive a heat distribution system as is possible. This can be accomplished by use of a single long conduit or by use of a manifold at the exit of the combustion chamber to distribute the combustion gases to two or more heating conduits. As the effective length of the heat distribution system increases, the back pressure on the combustion chamber and the chance of pulsation in the chamber also increase. The design of the combustion chamber is the single most important factor on controlling back pressure and pulsation.

The invention is more readily understood by reference to the accompanying drawings, of which:

Figure 1:
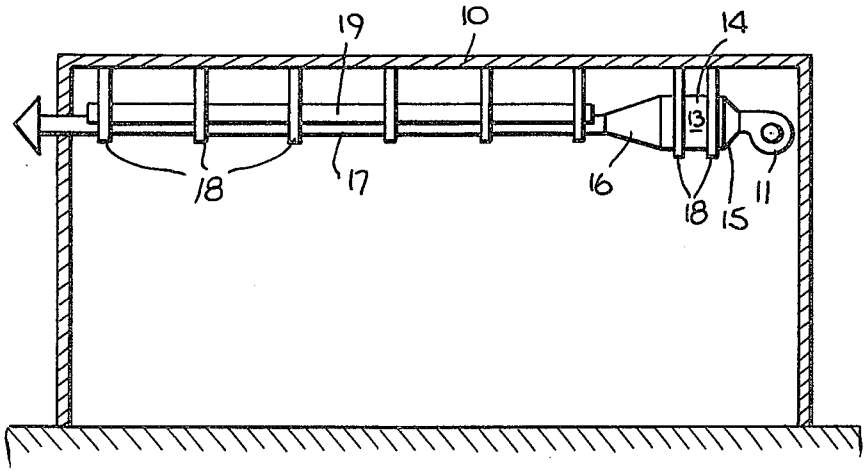
FIG. 1 is a side elevation view of a typical installation of a radiant heating system embodying the present invention.

FIG. 1 shows structure 10 having a heating system employing the combustion chamber of this invention suspended from its ceiling. The heating system comprises burner unit 11, combustion chamber 13, comprising tubular shell 14 and frustum-shaped end members 15 and 16, and heating conduit 17. Combustion chamber 13 and heating conduit 17 are suspended from the ceiling of structure 10 by suitable hangers 18, and conduit 17 is surmounted by reflector 19 to direct the radiant heat energy emitted by the top and sides of conduit 17 downwardly toward the area to be heated.

Figure 2:
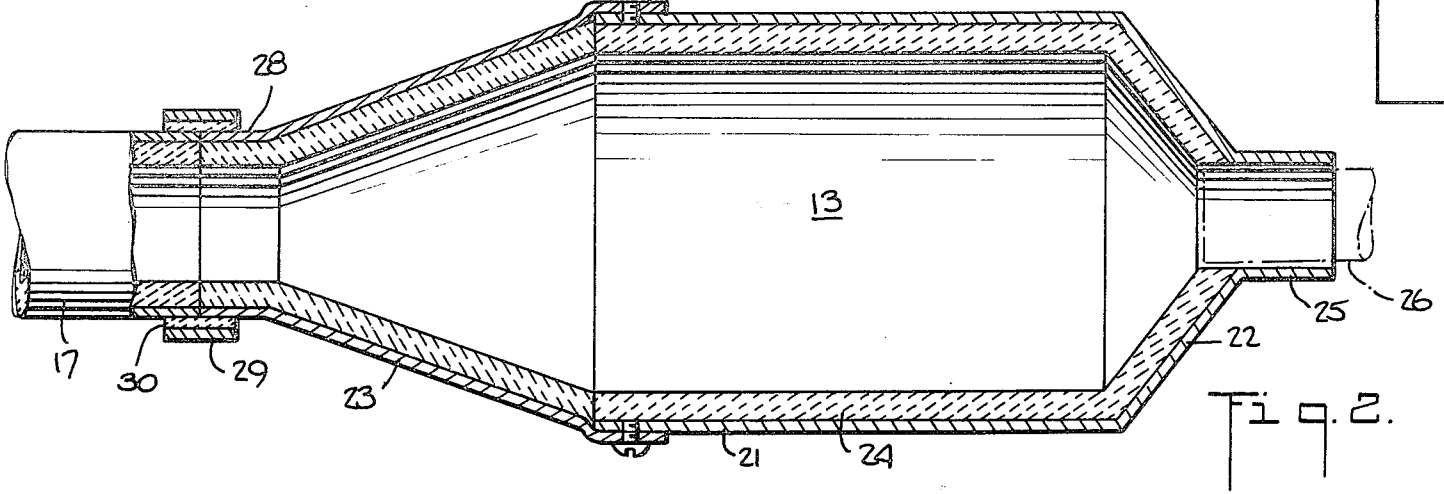
FIG. 2 is a longitudinal section view of the combustion chamber of this invention.

The detailed construction of combustion chamber 13 is shown in FIG. 2. Chamber 13 comprises generally cylindrical shell 21, tapered end members 22 and 23, and imperforate refractory lining 24. End member 22 has a greater degree of taper than opposed end member 23 and is provided with collar 25 which is adapted to receive the air tube of a fluid-fuel burner, shown in phantom 26. Shell 21, end member 22 and collar 25, are formed of suitable sheet metal and are preferably permanently affixed, as by welding or other suitable means.

End member 23, like shell 21, is formed of sheet metal, and desirably is removably attached to shell 21 to permit access to the inside of combustion chamber 13. In a preferred form, end member 23 is provided with a cylindrical rim which overlaps shell 21, and is attached to shell 21 by suitable fasteners, such as screws 27. When attached, the refractory lining of end member 23 is butted against the refractory lining of shell 21.

The narrow end of end member 23 is adapted for mounting heating conduit 17. In the form shown, cylindrical collar 28 is affixed (e.g. welded) to the outlet of member 23 and heating conduit 17 is butted against collar 28. Conduit 17 is secured to collar 28 by means of sleeve 29 which is provided with a suitable fastener, such as a screw fastener, not shown. Desirably sleeve 29 is provided with a thermally insulating lining 30. Still other means for connecting conduit 17 to chamber 13 will be apparent to one of ordinary skill in the art.

Refractory lining 24 is a lightweight, refractory, thermally insulating material. It should be lightweight to minimize the weight of the combustion chamber and to simplify the installation of the chamber. In addition, the refractory should have a high insulating capacity to minimize the thickness of the insulation and yet keep the external temperature of the combustion chamber at a minimum. Further, the refractory should have sufficient resistance to disintegration at combustion temperatures to afford a useful life to the chamber. The refractory can be permanently bonded to the chamber walls or it can be removable to permit its replacement if necessary. The refractory can extend into collar 28, as shown, and even through a portion of conduit 17, if desired.

In general, the refractory should have a density of no more than about 83 pounds per cubic foot, a thermal conductivity of no greater than about 2 Btu per square foot per hour per °F. per inch of thickness at 1600°F., and should be able to withstand temperatures of at least about 2000°F. One suitable material has a density of 50 lb/ft$^3$, a conductivity of 1.89 Btu/ft$^2$/hr/°F./in., and can withstand temperatures up to 2200°F. One commercially available material of this type is a castable refractory such as Kastolite which is sold by A. P. Green Refractories Company. A particularly preferred insulating material is a ceramic fiber insulation or a clay refractory, such as Kaowool manufactured by the Babock & Wilcox Company, Refractories Division, which has a density of 12 lb/ft$^3$, a conductivity of 0.91 Btu/ft$^2$/hr/°F./in. and can withstand temperatures of up to 2300°F.

The degree of taper of end members 22 and 23 is an essential feature of this invention. It has been found that a cylindrical chamber having flat ends is totally unsuitable for use in a single-pass, positive-pressure, high heating capacity, oil-fired radiant heating system. In such a chamber, high back pressure and pulsation occur. The back pressure causes the flame to be compressed in the combustion chamber toward the burner and may be high enough to cause the flame to be extinguished. In addition, combustion is inefficient, resulting in the formation of soot. When the ends are properly tapered, however, efficient combustion is achieved, pulsation is essentially eliminated, back pressure is minimized, and combustion gases are readily discharged from chamber 13 to conduit 17.

The particular dimensions of combustion chamber 13 are not narrowly critical, and obviously depend upon the size of the installation, especially the capacity of fluid-fuel burner 11. The dimensions are desirably selected so that the flame from burner 11 does not impinge on the internal surfaces of chamber 13, and yet should not be so large that the chamber is unduly bulky or heavy. The absence of flame impingement is the optimum situation, however, and it may or may not be achieved in actual use. End member 22 is sharply tapered to avoid pulsations as well as the formation of an air pocket or dead space at the inlet end of chamber 13. Partially burned combustion products can be trapped in this dead space, and form a soot deposit on the surface of the chamber. On the other hand, member 22 should not be so sharply tapered that the flame from burner 11 impinges on the refractory lining of member 22. In most cases a taper of from about 50° to about 70° from the axis of the chamber is useful, with a taper of about 65° being preferred.

End member 23 is tapered to essentially eliminate pulsation and to minimize the back pressure in chamber 13. The taper is more gradual than that of member 22, but the taper should not be so gradual that chamber 13 is unduly long. In general, the degree of taper should be sufficient to provide a total system back pressure (due to heating conduit 17 and the transition from chamber 13 to conduit 17) of no greater than 0.1 inch of water (static pressure), and preferably not greater than from about 0.07 to about 0.08 inches. In most cases a taper of from about 10° to about 25° from the axis of the chamber is useful, with a taper of about 15° being preferred. At this degree of taper, system back pressures of the order of about 0.03 to about 0.05 inches are feasible.

The remaining dimensions of the chamber are not narrowly critical, and are dictated largely by the desired size of the installation. In general, however, the maximum internal diameter of chamber 13 should be from about two to about six times, and preferably from about three to about four times the internal diameter of the outlet of chamber 13. The overall length of chamber 13 should be from about two to about six times, and preferably from about three to about four times the maximum internal diameter.

A combustion chamber designed as described above essentially eliminates pulsation, minimizes back pressure and permits highly efficient combustion and transfer of the combustion products to conduit 17. As a result it has been found desirable to ensure that at least the initial portion of conduit 17 has high thermal resistance. For example, it can be constructed of high temperature resistant metals, such as stainless steels capable of withstanding temperatures of up to about 1600°F. More desirably, it is constructed of more conventional metals and is provided with a refractory lining to avoid the use of expensive materials and to reduce the heat dissipation from conduit 17 at this section. The refractory can be the same as is employed in chamber 13. The more remote section of conduit 17 can be constructed of more conventional materials, e.g., carbon steel and the like.

As noted above, the combustion chamber of this invention is intended to be employed in combination with an oil-fired burner of high heating capacity. The construction of such burners are well-known to the art and form no part of this invention. It is intended, however, that the burner have a heating capacity of from about 150,000 to about 500,000 Btu per hour, with a heating capacity of from about 200,000 to about 300,000 Btu per hour being preferred. It is also important that the burner be equipped with a fan capable of supplying air at a rate sufficient to support combustion of the oil, and at a pressure sufficient to overcome the system back pressure. In general, burners having motors capable of operating at at least 2000 RPM, and preferably at least about 3000 RPM are suitable.

In a preferred form of the combustion chamber of this invention, cylindrical body 21 has a diameter of approximately 1 ft. and a length of 20 inches. End member 22 is a frustro-conical member having a height of approximately 3 inches fitted with collar 25 having a diameter of about 4 inches to receive burner air tube 26. End member 23 is a frustro-conical member having a height of approximately 16 inches. Thus the total length of combustion chamber 13 is approximately 39 inches. The chamber is provided with a 1-inch thick refractory lining. Heating conduit 17 is formed of 4½ inch diameter tubing having a length from about 80 to 100 ft. A conventional oil burner having a capacity of about 250,000 Btu per hour having a 3400 RPM motor is employed as the heat source. The total system is a highly efficient, yet simple heating system.

Although, in the embodiment shown, end members 22 and 23 have been shown as having a conical shape, it is obvious that the shape of the shell is not critical so long as the internal surfaces of the chamber have a configuration in accordance with this invention.

To ensure the safe and efficient operation of this system, it is desirable to employ certain control devices. In some conventional heating systems, the burner is thermostatically controlled whereby the fuel flow and the air fan are turned on and turned off simultaneously. In the present system, it is desired that the air flow be established before the fuel flow is established and prior to ignition and that the air flow be continued for a period of time after the cessation of fuel flow and combustion.

The initial air flow is employed before ignition to purge the system of combustible components, especially fuel oil vapors, in combustion chamber 13. Ordinarily, an air purge of from about 10 to about 30 seconds, preferably about 20 seconds, is sufficient for this purpose. The particular means employed to achieve this purge form no part of this invention, and are readily apparent to those of ordinary skill in the art. For example, when the burner is switched on, either manually or thermostatically, a delayed-action normally closed solenoid valve can be employed to prevent flow of fuel to the burner for the desired time interval, and then opened, allowing the fuel to flow and combustion to be established.

After combustion ceases, it is desired to continue the flow of air through the combustion chamber 13 and conduit 17 for a period of time after the flow of fuel has been shut off. When combustion ceases, the refractory lining of chamber 13 is at the combustion temperature (of the order of 2000°F.), and retains this heat for some time. This heat can be transmitted to burner 11, which can be damaged as a result. Accordingly, the air flow is desirably maintained for a period of time sufficient to cool chamber 13 to a temperature sufficient to avoid the risk of damage to burner 11. This has a second advantage in that, even after combustion has ceased, the heat retained by chamber 13 can be distributed to conduit 17 and thereby provide more even heating. Again, the specific means necessary to effect this are known to the art and are not a part of the invention. For example, a temperature sensing device can be located on the air tube of burner 11 and be operatively connected to the switch for the fan to keep it operating after the flame is extinguished. When the temperature of the air tube falls to a predetermined level (for example about 140°F.), the sensing device opens the switch and turns off the fan of burner 11.

Finally, it is desired to provide burner 11 with means for sensing whether combustion has been established within a predetermined period of time after fuel flow has been initiated and, if not, automatically turning off at least the fuel flow. In this way, the flow of oil to the burner is prevented in the event ignition is not established. Devices of this type, such as cadmium cells, are known and thus the particular device is not a feature of this invention.

Figure 3:
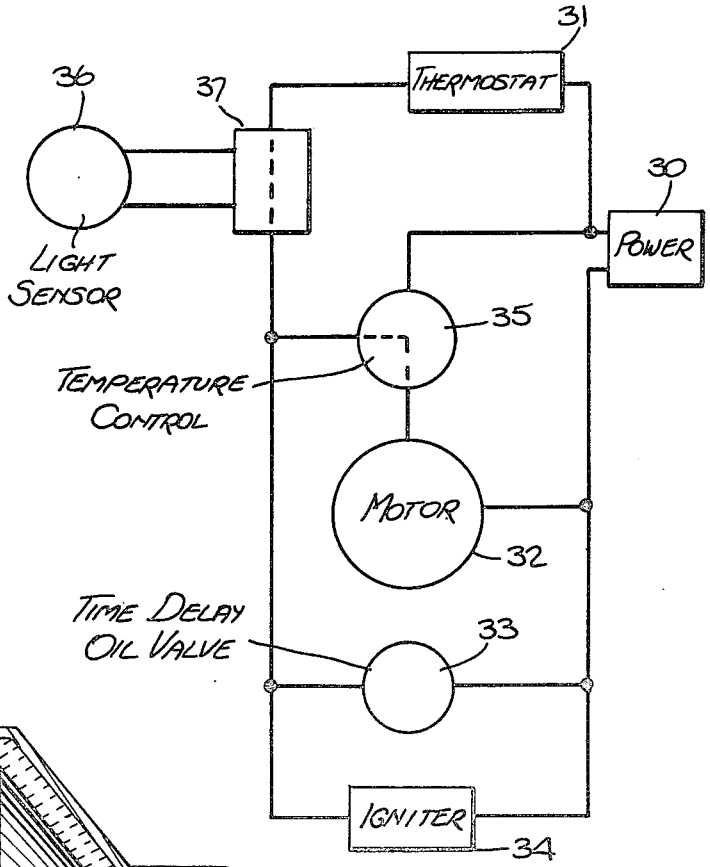
FIG. 3 is a schematic diagram of a control system employed in the heating system of this invention.

A suitable control system is illustrated schematically in FIG. 3. The system comprises power source 30, room thermostat 31, motor 32 which drives the air fan and the fuel oil pump, time-delay solenoid oil valve 33, fuel igniter 34, temperature control switch 35 responsive to the temperature of the burner air tube, light sensor 36 and time delay switch 37. As shown, the circuit is in the condition obtaining before activation of the system. When the system is activated, as by closing the circuit by thermostat 31, current flows through normally closed switch 37 and through normally closed temperature control 35 to turn on motor 32. Current also flows through a solenoid actuated, time delay oil valve 33, whereby, after a preselected period, e.g., 10 to 30 seconds, the valve is opened and fuel is fed to burner 11. Finally, current flows through fuel igniter 34 which ignites the fuel once the oil flow is established. If ignition does not occur, this is sensed by light sensor 36, such as a cadmium cell, which in turn opens time delay switch 37, shutting off power to motor 32, valve 33 and igniter 34. The circuit can be reset manually or automatically, as may be desired.

When combustion is established, the temperature of the burner air tube increases and once it exceeds the selected temperature, e.g., 140°F., temperature control 35 opens the circuit between switch 37 and motor 32 and closes the circuit between power supply 30 and motor 32, thereby continuing the operation of motor 32.

When the area being heated has achieved the maximum desired temperature, thermostat 31 opens the main circuit, cutting off power to and closing oil valve 33, thereby cutting off the flow of fuel to burner 11. Because power is applied to motor 32 directly from power supply 30 through temperature controller 35, motor 32 continues to run and operate the air fan until the temperature of the burner air tube falls below 140°F. Temperature controller 34 then opens the connection between power supply 30 and motor 32, thereby turning it off, and closes the connection between switch 37 and motor 32. The circuit is now restored to its original condition.

What is claimed is:

1. An improved radiant heating system comprising in combination a fluid-fired burner, a combustion chamber and, extending from said chamber, a tubular conduit for receiving the products of combustion from said burner and radiating infrared energy to the surroundings, wherein the improvement comprises a combustion chamber comprising a sheet metal shell and sheet metal end members, said shell being provided with an imperforate lining of a refractory material, whose internal surface is tapered at each end thereof, whereby the tapered surface at one end of said chamber has a high degree of taper to an axially positioned collar for receiving the air tube of a fluid-fired burner, and mounted in said collar, an axially positioned air tube of said fluid-fired burner having means for forcing air through the burner and combustion chamber, and the tapered surface at the other end of said chamber has a low degree of taper to a narrow outlet end, said outlet end having means to mount said tubular heating circuit extending away from said combustion chamber, the tapers of said one and other ends being such that pulsation is essentially eliminated and back pressure in the chamber is minimized.

2. A heating system according to claim 1 including a forced air, oil-fired burner having a heating capacity of from about 150,000 to about 500,000 Btu/hr.

3. A heating system according to claim 2 wherein the taper of said other end member is such that the total system back pressure on the combustion chamber is not greater than 0.1 inch of water when the system is operating.

4. A heating system according to claim 3 wherein the taper of the one end member of said chamber is from about 50° to about 70° from the axis of said chamber and the taper of the other end member of said chamber is from about 10° to about 25° from the axis of said chamber.

5. A heating system according to claim 4 wherein the cylindrical shell and the one end member of said chamber are permanently attached and the other end member of said chamber is removably attached to said cylindrical shell.

6. A heating system according to claim 1 wherein said chamber is provided with a lining of a refractory material having a density of no more than about 83 pounds per cubic foot and a thermal conductivity of no greater than about 2 Btu/ft$^2$/hr/°F./in.

7. A heating system according to claim 2 including means for establishing air flow through the system for a preselected period of time before establishing fuel flow to said burner, means for continuing air flow through the system for a preselected period of time after combustion has ceased, and means for terminating fuel flow to said burner a preselected period of time after initiation of such flow if combustion of said fuel has not been initiated.

8. An improved combustion chamber for a radiant heating system comprising in combination a fluid-fired burner and a combustion chamber, wherein the improvement comprises a combustion chamber comprising a sheet metal shell and sheet metal end members, said shell being provided with an imperforate lining of a refractory material, whose internal surface is tapered at each end thereof, whereby the tapered surface at one end of said chamber has a high degree of taper to an axially positioned collar for receiving the air tube of a fluid-fired burner having means for forcing air through the burner and combustion chamber, and the tapered surface at the other end of said chamber has a low degree of taper to a narrow outlet end, said outlet end having means to mount a tubular heating conduit for receiving the products of combustion from said burner and radiating infrared energy to the surroundings and extending away from said combustion chamber, the tapers of said one and other ends being such that pulsation is essentially eliminated and back pressure in the chamber is minimized.

9. A combustion chamber according to claim 8 including a forced air, oil-fired burner having a heating capacity of from about 150,000 to about 500,000 Btu/hr.

10. A combustion chamber according to claim 9 wherein the taper of said other end member is such that the total system back pressure on the combustion chamber is not greater than 0.1 inch of water when the system is operating.

11. A combustion chamber according to claim 10 wherein the taper of the one end member of said chamber is from about 50° to about 70° from the axis of said chamber and the taper of the other end member of said chamber is from about 10° to about 25° from the axis of said chamber.

12. A combustion chamber according to claim 8 wherein said chamber is provided with a lining of a refractory material having a density of no more than about 83 pounds per cubic foot and a thermal conductivity of no greater than about 2 Btu/ft$^2$/hr/°F./in.

* * * * *